US005232070A

United States Patent [19]

Blain

[11] Patent Number: 5,232,070

[45] Date of Patent: Aug. 3, 1993

[54] UP LEVELING CONTROL SYSTEM FOR SMALL ELEVATORS

[76] Inventor: Roy W. Blain, Böllinger Höfe, D-7100 Heilbronn, Fed. Rep. of Germany

[21] Appl. No.: 745,564

[22] Filed: Aug. 15, 1991

[51] Int. Cl.[5] ..... B66B 1/04

[52] U.S. Cl. ..... 187/29.2; 187/110

[58] Field of Search ..... 187/29.2, 110, 111; 137/596.12

[56] References Cited

U.S. PATENT DOCUMENTS

| | | | |
|---|---|---|---|
| 3,141,386 | 7/1964 | Loughridge | 91/361 |
| 3,474,811 | 10/1969 | Blain | 137/80 |
| 3,977,497 | 8/1976 | McMurray | 187/29 A |
| 4,153,074 | 5/1979 | Risk | 137/596.12 |
| 4,534,452 | 8/1985 | Ogasawara et al. | 187/29 A |
| 4,637,495 | 1/1987 | Blain | 187/29 A |
| 4,800,990 | 1/1989 | Blain | 187/17 |
| 4,825,909 | 5/1989 | Martin et al. | 137/596.12 |
| 4,938,119 | 7/1990 | Rita | 91/461 |

FOREIGN PATENT DOCUMENTS

| | | | |
|---|---|---|---|
| 2703349 | 4/1980 | Fed. Rep. of Germany . | |
| 2908020 | 4/1980 | Fed. Rep. of Germany . | |
| 3617666 | 9/1987 | Fed. Rep. of Germany . | |
| 2104870 | 3/1983 | United Kingdom | 187/110 |
| 8606359 | 11/1986 | World Int. Prop. O. | 187/111 |

*Primary Examiner*—Steven L. Stephan
*Assistant Examiner*—Thomas M. Dougherty
*Attorney, Agent, or Firm*—Eugene Chovanes

[57] ABSTRACT

An up leveling control system for small elevators that uses an adjuster having a small orifice coordinating with an up speed metering edge of a separate spool in the form of a taper to meter the rate of flow of pilot oil from a bypass chamber to control the position of a bypass valve and thereby regulate the volume of oil flow proportionately to the elevator cylinder and to the pump reservoir.

7 Claims, 1 Drawing Sheet

UP LEVELING CONTROL SYSTEM FOR SMALL ELEVATORS

STATEMENT OF THE INVENTION

This invention relates to a two-speed up control system for a hydraulic elevator.

REFERENCE TO COMPANION PATENT

This application is a companion to my prior U.S. Pat. No. 4,637,495 granted Jan. 20, 1987 for PRESSURE/-VISCOSITY COMPENSATED UP TRAVEL OF A HYDRAULIC ELEVATOR.

BRIEF DESCRIPTION OF THE PRIOR ART

Several methods for the up leveling of a hydraulic elevator are known whereby the slower speed or up leveling speed of the elevator is achieved by bypassing a part of the oil flow from the pump directly back to the reservoir of the power unit, allowing the remaining flow from the pump to be directed to the elevator cylinder, thereby producing the required up leveling speed. Examples of such systems, in addition to my above-referenced patent, are disclosed in U.S. Pat. Nos. 3,141,386, 3,478,811, 4,153,074, and 4,534,452.

In the case of residential elevators and other small elevators requiring extremely low rates of oil flow, existing up leveling valve designs as set forth above suffer from excess friction due to seals or the integration of other elements which cause a sensitive up leveling system to deviate from the constant speed desired.

SUMMARY OF THE INVENTION

An object of the invention is to provide a simple, low-priced, reliable, adjustable up leveling speed for elevators.

Another object of the invention is to provide a stable up leveling operation at very low rates of oil flow, such as two liters per minute or ½ gpm.

Another object of the invention is to achieve the above throughout wide variations in operating pressures and oil temperature.

Another object of the invention is to achieve the above such that the system is impervious to unclean oil.

DETAILED DESCRIPTION

Figure 1:
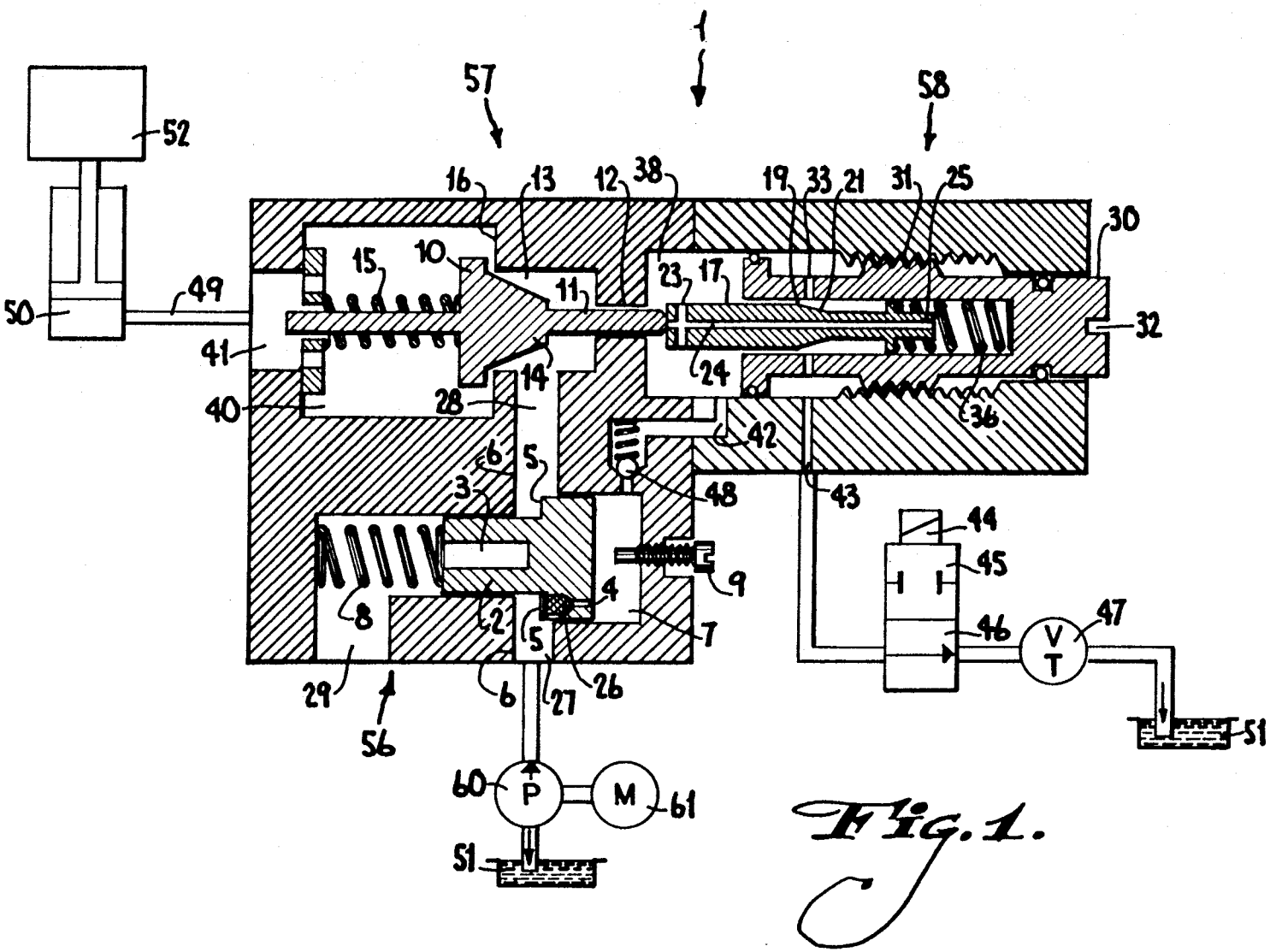
FIG. 1 is a schematic hydraulic circuit diagram illustrating the up control section of a hydraulic elevator valve consisting of a bypass valve, a check valve and a flow regulator.

FIG. 1 shows a valve body 1 into which the three main assembly elements; bypass valve assembly 56, check valve assembly 57 and up leveling speed regulator assembly 58, are positioned.

When the pump is not running, the bypass valve 2 with flow metering slots 3 is kept in its open position by bypass spring 8 which holds the bypass valve 2 against the bypass adjuster 9. The check valve 10 is held in its closed position by check valve spring 15 and also by the oil pressure in check valve chamber 40 connected with the elevator cylinder 50 oil pressure through elevator cylinder connecting line 49.

Oil pump 60 driven by electric motor 61 provides the main oil flow into pump oil flow channel 27. Depending on the switched position of solenoid valve 44 effecting the position of the bypass valve 2, the oil volume under pump pressure will flow through channel 27, through flow metering slot 3 in the bypass valve 2 and through oil return channel 29 back to oil reservoir 51. In this case, the elevator 52 will move at slow speed.

Alternatively, with solenoid valve 44 in its closed position 45 causing the bypass valve 2 to close, oil will flow under pressure from through channel 27 through channel 28, through check valve 10, through check valve chamber 40, into elevator cylinder connecting line 49, and to elevator cylinder 50 which raises the elevator 52 at full speed.

When the oil pump 60 is running, bypass valve orifice 4 protected by filter 26 in bypass valve 2 allows oil to flow into bypass valve chamber 7 where it builds up pressure to force bypass valve 2 closed against bypass spring 8. Flow from oil pump 60 is then forced to pass through oil channel 28, to check valve 10 which opens, through elevator cylinder connecting line 49 and into elevator cylinder 50.

Bypass valve filter 26 because of its proximity to the main turbulent oil flow from oil pump 60, is self-cleaning, which is of significant importance for reliable and service-free operation of the system.

The degree of taper of check valve spool 14 of check valve 10 determines how far check valve 10 must open to allow a specific volume of oil to flow to cylinder 50 when the oil pump 60 is running. The length of opening movement of the check valve 10 is a measure which indicates the rate of flow of oil and therefore the up speed of elevator 52. Check valve stem 11 of the check valve 10 is a close fit in the housing bore 12, and serves the purposes of moving up speed spool 17 against the up speed spool positioning spring 36 and also of metering a controlled leakage of oil from the pump pressure chamber 13 into the bypass pressure chamber 38 of the up speed spool 17, the purpose of which shall be explained later.

The up speed spool 17, essentially a close fit in up speed adjuster 30, meters the flow of oil in the pilot pressure system between the bypass valve chamber 7 and he reservoir tank 51. The up speed spool 17 consists of a taper 21, a metering edge 19, up speed flow passages 23 and 24, and a spring centering stem 25. A suitable angle of taper of the metering edge 19 is approximately 2°. Up speed positioning spring 36 forces the up speed spool 17 against the check valve stem 11 so that the up speed spool 17 and check valve stem 11 move as one unit whenever oil flows through check valve 10. The advantage of up speed spool 17 and check valve stem 11 being separate is that close tolerance fits of the diameters are possible without the danger of the parts binding or being subject to unrequired friction during their axial movement.

Up speed adjuster 30 can be screw-adjusted along its axis by means of upspeed adjuster socket 32 and up speed thread 31, in either direction to increase or decrease the up leveling speed of elevator 52. This is achieved in that up speed adjuster orifice 33 in up speed adjuster 30, in relation to the position of metering edge 19 of up speed spool 17, controls the flow of pilot oil out of the bypass valve chamber 7 which in turn controls the position of bypass valve 2 and thereby the volume of oil being directed back to the reservoir tank 51 through metering slots 3. The remaining volume of oil from oil pump 60 flows to elevator cylinder 50.

Solenoid valve 44, in opening the passage for pilot oil from bypass valve chamber 7 to reservoir tank 51 via the up speed control, initiates the elevator speed change from fast speed into leveling speed.

Throttle 47 controls the rate of pilot oil flow exhausting to the tank and thereby the rate of change of speed of the elevator 52 from fast to leveling speed; in other words, the deceleration of the elevator.

OPERATION

As the pump 60 is started and solenoid 44 energized so that solenoid valve 44 takes up closed position 45, oil initially flows from pump 60, through flow metering slots 3 of bypass valve 2, and back to reservoir tank 51. At this instant, there is no flow to elevator cylinder 50.

The back pressure, caused by the restricting effect of flow metering slots 3 of bypass valve 2, whose slot size is adjustable through adjuster 9, increases, causing oil to flow through bypass valve orifice 4. This causes a build up of pressure in bypass valve chamber 7, causing bypass valve 2 to close smoothly. Since flow from pump 60 no longer can pass freely through bypass valve 10 back to reservoir tank 51, pressure in chamber 13 of check valve 10 builds up until it overcomes the force of check valve spring 15 together with the oil pressure on the check valve 2 in chamber 40, causing check valve 2 to open and oil flow to pass through check valve 2 to elevator cylinder 50, resulting in elevator 52 accelerating upwards into full speed as bypass valve 2 fully closes.

It should be noted that check valve 2 in its fully open or back position together with attached check valve stem 11, the up speed spool 17 under pressure from up speed spool positioning spring 36 is in its forward position pressing against check valve stem 11. In this forward position metering edge 19 exposes up speed adjuster orifice 33 of up speed adjuster 30.

With the operation of a slowdown switch in the elevator shaft, an electrical command for the elevator to change from full speed into leveling speed is transmitted to solenoid valve 44 which is de-energized, allowing solenoid valve 44 to move into its open position 46. An outlet for pilot flow from bypass valve chamber 7, through pilot line check valve 48, through passages 23 and 24 of the up speed spool 17 through orifice 33, pilot oil passage 43, solenoid valve open position 46, and throttle 47 to reservoir tank 51 is thus provided.

This causes oil pressure in the bypass chamber 7 to fall and bypass valve 2 to open under pressure exerted by bypass spring 8 and oil pressure under bypass valve seat 5. As bypass valve 2 opens, part of the oil previously flowing to cylinder 50 now passes through bypass valve 2 to reservoir tank 51. With less oil flowing through the check valve 10, check valve 10 starts to close. Check valve stem 11 pushes the up speed spool back against its spring 36 until the metering edge 19 begins to cover up speed adjuster orifice 33. This partial blockage at orifice 33 reduces the flow of pilot oil passing from bypass valve chamber 7 to reservoir tank 51, to the point where the oil flowing out of bypass valve chamber 7 through orifice 33 is equal to the oil flowing into the chamber 7 through bypass valve orifice 4. A state of hydraulic balance then occurs with the metering edge 19, whose position is directly related to the flow of oil through check valve 10, controlling the flow of pilot oil through orifice 33, which controls the position of bypass valve 2, which controls the flow through the check valve 10. A stable closed circuit control system is the result.

By turning on speed adjuster 30 by means of a key in socket 32, and through a screw thread 31, the position of orifice 33 can be axially changed so that a different up speed can be set.

Because thinner oil due to higher oil temperatures can pass through a smaller opening than thicker oil, the hydraulic balance described above in the case of hot oil takes placed with the check valve slightly more closed than with colder oil; that is to say, with less oil flow passing through check valve 10 to elevator cylinder 50 and therefore with a slower up leveling speed. In order to compensate for this undesirable slowing down effect at higher oil temperatures, a small flow of pilot oil is allowed to leak between the check valve stem 11 and bore 12 of the check valve 10 body.

This small leakage which increases in volume as the oil becomes warmer and thinner adds to the flow of pilot oil already passing between metering edge 19 and up speed adjuster orifice 33, and has the effect of causing metering edge 19 to open up orifice 33 a slight amount by causing bypass valve 2 to close tightly, in turn causing more oil to flow through check valve 10 to elevator cylinder 50, and thus maintain the required leveling speed.

Since the amount of this leakage increases significantly with the increase in oil temperature, an automatic compensation of flow through check valve 10 takes place as metering edge 19 along with check valve 10 moves to allow the increased pilot oil flow to pass through up speed adjuster orifice 33.

Because the up acceleration of the elevator 52 should depend only upon the rate of pilot oil flowing through bypass valve orifice 4, alone, it is necessary to position a small pilot line check valve 48 in the passage 42 to prevent the oil intentionally being leaked through bore 12 of the check valve 10 body to flow through passage 42 into bypass valve chamber 7 where it would otherwise cause bypass valve 2 to close at a faster rate, particularly at higher oil temperatures.

I claim:

1. In a control system for a hydraulic elevator 1) a pump (60),
2) a supply of oil under pressure provided by the pump (60),
3) a return including a reservoir tank (51) for such oil,
4) an elevator cylinder (50) supporting an elevator (52),
5) check valve assembly (57) means
   a) including a check valve (10), a pump pressure chamber (13), and a check valve chamber (40),
   b) connecting the pump (60) supply with the elevator cylinder (50),
6) bypass valve assembly (56) means including a bypass valve (2)
   a) connected across the pump (60) supply and return for bypassing the check valve (10),
   b) wherein bypass valve (2) is biased in an open position by a spring (8), and
   c) having a bypass chamber (7) for receiving hydraulic fluid under pressure from the pump (60),
7) a fluid restrictor (4)
   a) for displacing the bypass valve (2) to a closed position against the force of spring (8), and
8) means, including a solenoid valve (44), for connecting the bypass chamber (7) with the pump (60) return;

the improvement comprising 1) up leveling speed regulator assembly (58) means for controlling the up leveling speed of the elevator (52) including an up speed adjuster (30) with an up speed adjuster orifice (33) that coordinates with an up speed metering edge (19) in the form of a taper (21) on a separate up speed spool (17) to regulate the volume of oil proportionately to the elevator cylinder (50) and the reservoir tank (51),
2) an up speed spool chamber (38) in up leveling speed regulator assembly (58) immediately adjacent to pump pressure chamber (13) in check valve assembly (57) and
3) wherein up speed spool chamber (38) is displaced substantially away from check valve chamber (40) and the up leveling speed regulator assembly (58) being positioned in up speed spool chamber (38).

2. The system of claim 1 wherein the diameter of the up speed adjuster (33) orifice is approximately 0.5 mm and the angle of taper of the metering edge (19) is approximately 2°.

3. The system of claim 1, wherein an up speed spool passage (23, 24) for pilot oil flow passes through the up speed spool (17) to provide access of flow from the bypass chamber (7) to the orifice (33).

4. The system of claim 1, wherein a controlled leakage of oil from pump chamber (13) to up speed spool chamber (38) joins pilot oil from bypass valve chamber (7) to effect a correction in the position of metering edge (19) to offset viscosity changes in the oil as its temperature varies to present a slowing down in the up leveling speed of the elevator (52) as oil temperatures increase.

5. The system as in claims 1 or 4, having means including a check valve (48) for preventing leakage of oil through bore (12) from effecting the up acceleration of the elevator at the start of up travel.

6. The system of claim 1, including a filter (26) in bypass valve (2) located in a position wherein it is cleaned of contaminates by a turbulence of oil, the turbulence of oil being discharged through the channel (27) in the proximity of filter (26), causing an contamination which may have settled against filter (26) to be washed away to non-sensitive parts of the system.

7. The system of claim 1, wherein the improvement
(a) permits the oil to leak from the pump pressure chamber (13) only,
(b) eliminates any substantial effect from the oil on the elevator (52) leaking down,
(c) uses the oil leak to reduce friction in the regulator (58) means, and
(d) further uses the oil leak to provide a necessary compensation within the pilot central circuit.

* * * * *